United States Patent [19]

Tani formerly Nishikawa et al.

[11] 4,080,059

[45] Mar. 21, 1978

[54] APPARATUS FOR CLEANING A PHOTOSENSITIVE MEMBER OF AN ELECTROPHOTOGRAPHIC COPYING MACHINE

[75] Inventors: Tatsuo Tani formerly Nishikawa, Tokyo; Takashi Yano, Yokohama; Ichiro Fukushima, Tokyo; Toshio Hayashi, Yokohama; Susumu Tatsumi, Kawasaki; Sakae Ota, Tokyo, all of Japan

[73] Assignee: Ricoh Company, Ltd., Japan

[21] Appl. No.: 651,253

[22] Filed: Jan. 22, 1976

[30] Foreign Application Priority Data

Jan. 23, 1975 Japan ..... 50-11125

[51] Int. Cl.[2] ..... G03G 21/00

[52] U.S. Cl. ..... 355/15; 15/256.51

[58] Field of Search ..... 355/15; 15/256.51, 1.5

[56] References Cited

U.S. PATENT DOCUMENTS

| | | | |
|---|---|---|---|
| T893,001 | 12/1971 | Fisler | 355/15 X |
| 3,128,683 | 4/1964 | Rubin | 355/15 X |
| 3,576,624 | 4/1971 | Matkan | 355/15 X |
| 3,654,654 | 4/1972 | Abreu et al. | 355/15 X |
| 3,711,796 | 1/1973 | Saito et al. | 15/256.51 X |
| 3,776,632 | 12/1973 | Smith et al. | 355/15 |

*Primary Examiner*—R. L. Moses

[57] ABSTRACT

An apparatus for cleaning an endless photosensitive surface includes a photoreceptor rotatable around a horizontal axis in an electrophotographic copying machine. A cleaning roller and an edge of a blade are maintained in frictional engagement with the upper run of the rotating surface and into the space between the roller and the blade, a cleaning liquid is continuously supplied onto the surface between the blade edge and the cleaning roller, thereby achieving an effective cleaning function. The liquid within the space tending to flow over the other edge of the blade remote from the photosensitive surface and to then drip on the cleaned surface, is effectively prevented in accordance with the invention.

11 Claims, 7 Drawing Figures

APPARATUS FOR CLEANING A PHOTOSENSITIVE MEMBER OF AN ELECTROPHOTOGRAPHIC COPYING MACHINE

BACKGROUND OF THE INVENTION

The invention relates to an apparatus for cleaning a photosensitive member of an electrophotographic copying machine of the type employing a wet developing process to produce a visual image which is transfered onto a transfer sheet.

In an electrophotographic copying machine, an electrostatic latent image is formed on a photosensitive member and is developed to form a visual image, which is transfered onto a record sheet. Since the single photosensitive member is repeatedly used, there is a need for the provision of an apparatus for cleaning the surface of the photosensitive member for each copying cycle so that any residual toner may be removed therefrom in readiness for a new copying cycle after the visual image has been transfered onto the record sheet. If the residual toner is allowed to remain on the surface of the photosensitive member after completion of the transfer step, it may cause a marring of the record sheet during the next copying cycle or it may be firmly adhered to the surface of the photosensitive member to degrade its functioning. Usual cleaning technique employs a relatively thin blade of a resilient material, the edge of which is held in abutment against the surface of the photosensitive member to remove any residual toner therefrom, and such technique is particularly effective in an electrophotographic copying machine of a wet developing type. It is customary to supply a cleaning liquid to the surface of the photosensitive member adjacent the edge of the blade on the side the toner is removed, in order to ensure a smooth movement of the photosensitive member relative to the blade and to flush away any residual toner which is scraped off the surface thereof. In order to achieve an intended cleaning effect, it is necessary to hold the blade under pressure against the surface of the photosensitive member, but such blade pressure may frequently cause a damage to the photosensitive member. In order to avoid such drawback, it has been proposed to dispose a releasing member of soft material such as sponge or felt, which can be wet by the cleaning liquid, in contact with the surface of the photosensitive member so that any residual toner can be freed or released from the surface thereof before it is scraped off by the blade. Such an arrangement is shown in FIG. 1, which will be described below.

Referring to FIG. 1, the cleaning apparatus shown essentially comprises a blade 1, a releasing member in the form of a roller 2, made of sponge material, and a pipe 3 for supplying a cleaning liquid 4. The blade 1 is disposed so that its edge is held in abutment against the surface of a phootosensitive member 10 which is shown as a drum while its other edge is held by a holder 1'. The roller 2 has a rotary shaft which is disposed substantially parallel to the rotary shaft of the drum 10, and is disposed in abutting relationship with the surface of the drum 10 in a manner such that its region of contact undergoes an elastic deformation. In operation, before the drum 10 is set in motion, a quantity of cleaning liquid 4 is supplied through the pipe 3 to the cleaning station, that is, that portion of the surface of the drum which is defined between the blade 1 and the roller 2. Part of the cleaning liquid 4 may be bled from the piping 3 to be supplied to the roller 2 directly, as by passing it through its rotary shaft which is made hollow and formed with a multiplicity of apertures. The cleaning liquid 4 supplied forms a pool in the cleaning station, wetting the roller 2. The remaining portion of the cleaning liquid freely falls off the opposite ends of the drum or is collected into a suitable liquid reservoir through drainage ducts disposed at such end, as well known in this field of the art. The cleaning liquid usually comprises a developing solution or matrix therefor. As the drum 10 is set in motion and a copying operation proceeds to complete a transfer of the visual image onto the record sheet, the surface portion of the drum 10 to which a residual toner is left deposited reaches the position of the roller 2. Roller 2 rotates in the opposite direction from the drum while squeezing its impregnated cleaning liquid 4 into the area of its contact with the drum surface, thus releasing any residual toner which attaches to the drum surface, by its rubbing action. The released toner is then flushed away by the cleaning liquid 4 which is supplied through the pipe 3, and any remaining toner is completely scraped off the drum surface by the blade 1 to be carried away by a flow of the cleaning liquid 4 falling off the opposite ends of the drum. The supply of the cleaning liquid 4 is continued in the meantime, thus maintaining the wetting on roller 2. With this apparatus, since the toner is initially moistened or rendered readily separable from the drum surface by the releasing member of roller 2, the pressure with which the blade 1 is held against the drum can be substantially reduced, thus almost completely avoiding damage to the drum which may be caused by the blade 1.

However, when a series of copying cycles is terminated, and a new copying operation is initiated after a pause, the level of the cleaning liquid in the cleaning station may temporarily rise and sometimes an overflow, over the blade 1 may occur (see FIG. 2) as the cleaning liquid 4 is supplied through the pipe 3 if the roller 2 is already sufficiently wet. As the drum 10 and the roller 2 rotate to squeeze the cleaning liquid which is retained in the roller, and as the drum surface moves to cause a flow of the liquid and the rotation of the roller 2 causes ripples, the overflow of the cleaning liquid may be further increased. Such a phenomenon is particularly noticeable in a cleaning apparatus of the type in which the supply of the cleaning liquid is continued independently from the motion of the drum during the time the master switch of the copying machine is turned on. Such an overflow of the cleaning liquid may run down the drum surface, as shown at 4', to cause a non-uniformity in the charging or insufficient exposure, producing a trace pattern on the record sheet obtained.

SUMMARY OF THE INVENTION

In view of the foregoing, it is an object of the invention to provide an apparatus for cleaning a photosensitive member which prevents a dripping of a cleaning liquid onto the surface of the photosensitive member which is to be freshly charged and exposed, as the liquid is supplied to a cleaning station.

DETAILED DESCRIPTION OF EMBODIMENTS

Figure 1:
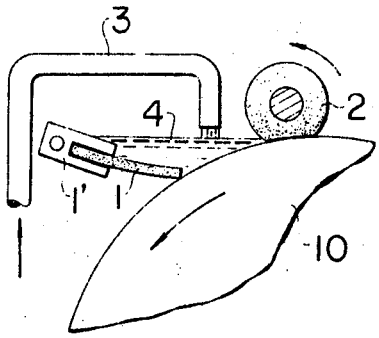
FIG. 1 (PRIOR ART)
FIG. 1 is a schematic side elevation of a conventional apparatus for cleaning a photosensitive member.
Figure 2:
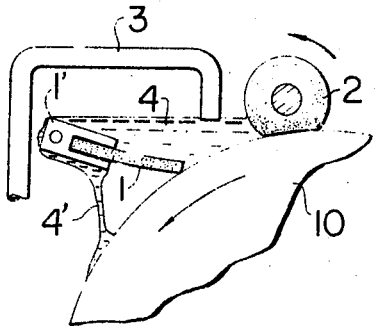
FIG. 2 (PRIOR ART)
FIG. 2 is a similar view illustrating a dripping of a cleaning liquid onto the surface of the photosensitive member which is to be freshly charged and exposed.
Figure 3:
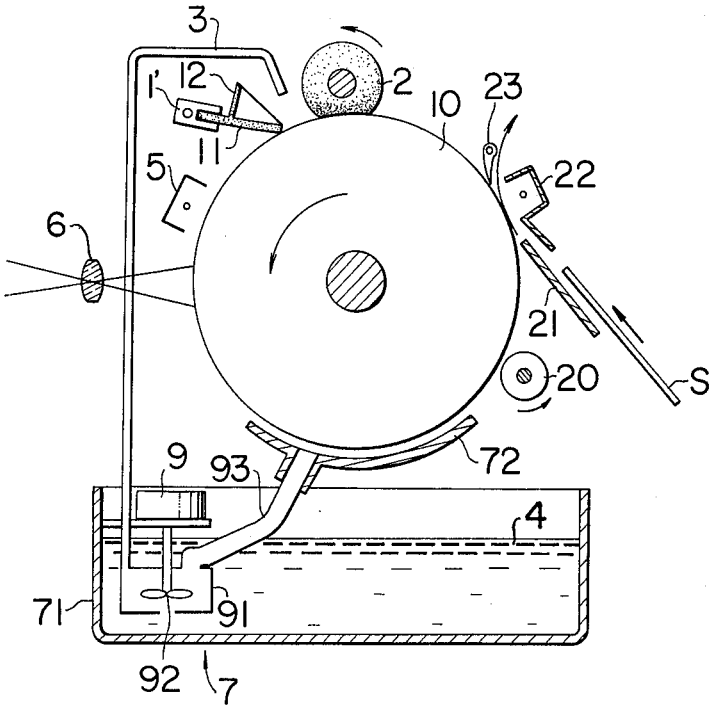
FIG. 3 is a schematic side elevation, partly in section, of an electrophotographic copying machine incorporating one embodiment of the cleaning apparatus according to the invention.
Figure 4:
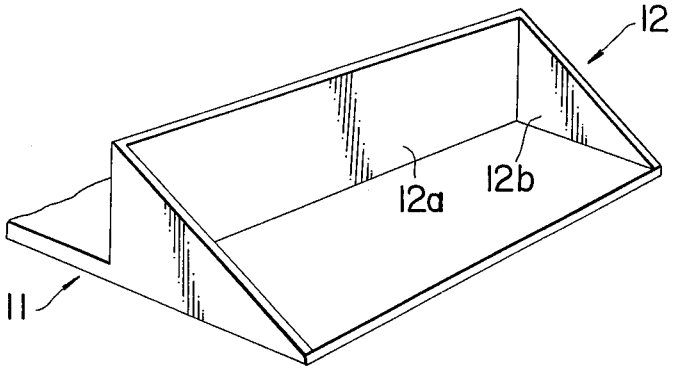
FIG. 4 is a perspective view of a liquid weir shown in FIG. 3.
Figure 5:
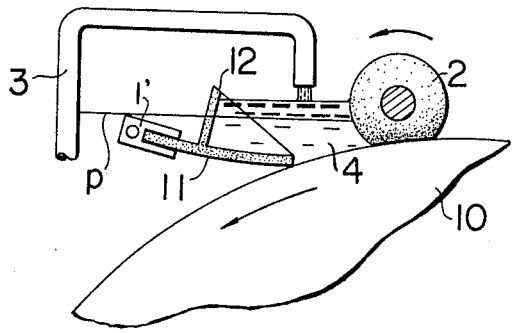
FIG. 5 is a fragmentary and enlarged side elevation of the embodiment of FIG. 3.

Throughout the drawings, similar parts as shown in FIGS. 1 and 2 are designated by like numerals. Referring to FIG. 3, there is shown an electrophotographic copying machine which incorporates the cleaning apparatus according to the invention. The machine comprises a photosensitive member 10 in the form of a drum, a charger 5, an exposure unit or exposure optical system 6, a developing unit 7, a squeeze roller 20, a transfer unit having a record or transfer sheet guide 21, a transfer charger 22, and a cleaning means according to the invention for cleaning the photosensitive member. Specifically the apparatus comprises a cleaning roller 2, a washing means having a pipe 3, and a blade 11 having a scraper and engaging member 10. Associated with the blade 11 is a liquid retaining means. Referring to FIG. 4, the blade 11 is integrally formed with a liquid weir 12 in accordance with the invention. As shown, the liquid weir 12 comprises upright rear wall 12*a* which is spaced from the edge of the blade 11 which is to be held in abutment against the drum surface, and a pair of sidewalls 126, having an upper end which extends from the top of the rear wall 12*a* to the toner removing edge of the blade 11. It will be appreciated that the sidewall 12*a* has a height which is sufficient to prevent the overflow of the cleaning liquid over its holder 1′ when the blade 11 is used in the manner illustrated in FIG. 3. FIG. 5 shows that the liquid weir 12 is effective to prevent a dripping of the cleaning liquid which would occur in the absence of the weir 12 if the level of the cleaning liquid rises above the level *p*.

A copying cycle of the copying machine will be described below. When the master switch (not shown) of the machine is turned on, a motor 9 is energized to rotate a screw 92 of a pump 91 which is disposed within a tank 71 of a developing unit 7, which contains a supply of developing solution. The developing solution 4 is partly pumped through a pipe 93 to a dishplate 72 which is located in juxtaposition with a portion of the drum 10, and is also partly pumped through the pipe 3 to the washing station to serve as a cleaning liquid. When a switch (not shown) which initiates a copying cycle is turned on, the drum 10 and the roller 2 are driven for rotation in the counterclockwise direction. The surface of the drum 10 is uniformly charged by the charger 5, and is then exposed to light image through the optical system or exposure means 6 to form an electrostatic latent image thereon. As the surface portion of the drum which is formed with the latent image passes by the dishplate, the latent image is developed by the developing solution 4 to be converted into a visual image on the drum surface. An excess amount of developing solution which wets the drum surface is removed by the squeeze roller 20. In timed relationship with the rotation of the drum 10, a record or transfer sheet S is fed along the guide 21 into the transfer station, namely, into the space between the transfer charger 22 and the drum surface so as to be brought into overlying relationship with the visual image on the latter. At the same time, the transfer charger 22 located on the rear side of the record sheet produces a corona discharge of the opposite polarity from that of the toner which forms the visual image, which is therefore transferred onto the record or transfer sheet S. After the transfer, the record or transfer sheet S is separated from the drum surface by a separation pawl 23 and is fed in the direction of an arrow to be delivered externally of the copying machine after having experienced a suitable processing. On the other hand, the drum surface, from which the visual image has been transferred, passes under the releasing member or cleaning roller 2, where any residual toner is released or loosened from the drum surface and is washed with the developing solution which serves as the cleaning liquid to be subsequently scraped off by the blade 11. It will be understood that the loosened or scraped toner will be carried away by the cleaning liquid. This completes one copying cycle, which can be repeated as many times as desired. Upon termination of a required number of copying cycles, the rotation of the drum 10 and the roller 2 is stopped, but so long as the master switch of the machine is turned on, the motor 9 continues its operation, so that the developing solution continues to be supplied to the developing dishplate and to the cleaning station. As a consequence, the developing solution supplied to the cleaning station sufficiently wets the roller 2, so that when commencing a new copying cycle, there may be a rise in the liquid level as mentioned previously, but the liquid weir 12 integral with the blade 11 prevents a dripping of the cleaning liquid as mentioned previously.

Figure 6:
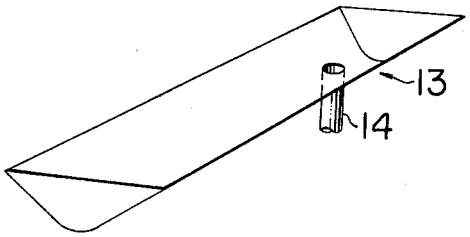
FIG. 6 is a perspective view of a liquid receiving tray which prevents a dripping of the cleaning liquid.
Figure 7:
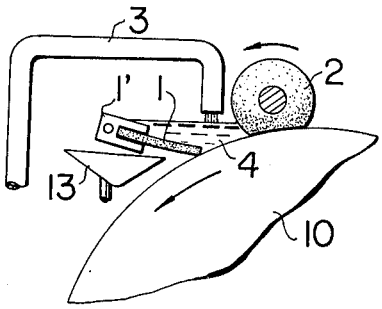
FIG. 7 is a fragmentary side elevation of another embodiment of the invention using the tray of FIG. 6.

As an alternative arrangement, FIG. 6 shows a liquid retaining means having a trough-shaped liquid receiving tray 13 which may be disposed below the blade 1, as illustrated in FIG. 7. The cleaning liquid which overflows the blade 1 is received into the tray 13 and is collected through a draining pipe 14. It should be understood that the blade 11 having the integral liquid weir 12 may be used in combination with the liquid receiving tray.

It should be understood that the configuration of the releasing member is not limited to a roller, and that the invention is equally applicable to an electrophotographic copying machine which employs a belt-shaped photosensitive member.

What is claimed is:

1. An apparatus for cleaning an endless photosensitive surface of photoreceptor means having a given width and rotatable around a horizontal axis in an electrophotographic copying machine, comprising a. means maintained in frictional engagement with a portion of the upper run of said rotating surface for releasing residual toner therefrom, b. blade means disposed downstream of said releasing means in view of the direction of rotation of said surface and having a first edge maintained in frictional engagement with said rotating surface over the entire width of the surface for scraping the toner released off the surface, and having a second edge spaced from said first edge, c. means for continuously supplying a cleaning liquid to the space between said releasing means and said blade means so as to enhance the cleaning function, the liquid within said space being permitted to fall off the opposite ends of said surface, and d. means associated with said blade and spaced from said first edge for preventing the liquid within said space from overflowing said second edge of said blade means, onto a portion of said surface, said catching means comprising a weir attached to said blade means, spaced from said first edge.

2. An apparatus for cleaning an endless photosensitive surface of photoreceptor means having a given width and rotatable around a horizontal axis in an electrophotographic copying machine, comprising a. means maintained in frictional engagement with a portion of the upper run of said rotating surface for releasing residual toner therefrom, b. blade means disposed downstream of said releasing means in view of the direction of rotation of said surface and having a first edge maintained in frictional engagement with said rotating surface over the entire width of the surface for scraping the toner released off the surface, and having a second edge spaced from said first edge, c. means for continuously supplying a cleaning liquid to the space between said releasing means and said blade means so as to enhance the cleaning function, the liquid within said space being permitted to fall of the opposite ends of said surface, and d. catching means associated with said blade and spaced from said first edge for preventing liquid within the space which overflows from said second edge of said blade means from falling onto a portion of said surface, said catching means comprising a tray for receiving a dripping of cleaning liquid which has overflowed said second edge of said blade means being adjacent and below said second edge.

3. An apparatus for cleaning an endless photosensitive surface of photoreceptor means having a given width and rotatable around a horizontal axis in an electrophotographic copying machine, comprising a. means maintained in frictional engagement with a portion of the upper run of said rotating surface for releasing residual toner therefrom, b. blade means disposed downstream of said releasing means in view of the direction of rotation of said surface and having a first edge maintained in frictional engagement with said rotating surface over the entire width of the surface for scraping the toner released off the surface, and having a second edge spaced from said first edge, c. means for continuously supplying a cleaning liquid to the space between said releasing means and said blade means so as to enhance the cleaning function, the liquid within said space being permitted to fall of the opposite ends of said surface, and d. means associated with said blade and spaced from said first edge for preventing the liquid within said space from overflowing said second edge of said blade means, onto a portion of said surface, said blade means comprising a blade member made from a resilient material and said overflow preventing means comprises a weir formed integral with said blade member.

4. A cleaning apparatus for an electrophotographic copying machine comprising a member having a photosensitive surface, means for mounting said member for movement in an operation direction, a charger facing said surface for charging said surface, an exposure unit for exposing said surface to a light image and forming a latent electrostatic image thereon spaced from said charger in the operation direction, a developing unit for developing a visual image corresponding to said latent image and having a developing solution therein which contacts said surface and being spaced from said exposure unit in the operation direction, a transfer unit having means for delivering a transfer sheet for transfering said visual image from said surface to said transfer sheet and being spaced from said developing unit in the operation direction, and cleaning means spaced from said transfer unit in the operation direction for removing excess developing solution from said surface, said cleaning means including a cleaning roller engageable with said surface and being moveable relative to said surface to release said excess developing solution from said surface, a blade pivotally mounted adjacent said surface and having an outer scraper end engageable with said surface at a location adjacent said cleaning roller, washing means for supplying developing solution to said surface between said cleaning roller and said blade, said blade extending obliquely downwardly to said surface and entraining accumulated developing solution and developer loosened by said cleaning roller thereon, and liquid retaining means associated with said blade and preventing the solution from falling downwardly to said surface.

5. A cleaning apparatus according to claim 4, wherein said developing unit further comprises a reservoir for holding said developing solution spaced below said surface, pump means for supplying said solution to said washing means from said reservoir, and return conduit means associated with said blade for returning said developing solution to said reservoir.

6. A cleaning apparatus according to claim 5, wherein said liquid retaining means further comprises a wall extending substantially upwardly from said blade at a position spaced from said surface on said blade, said wall forming a liquid weir.

7. A cleaning apparatus according to claim 5, wherein said liquid retaining means further comprises a through-shaped liquid retaining tray spaced blow said pivotal blade, and a drainage pipe extending between said tray and said reservoir.

8. A device for cleaning the photosensitive surface of an electrophotographic copying machine, said surface being adapted for receiving a developing solution, comprising a cleaning roller engageable with said surface and being movable relative to said surface to release said excess developing solution from said surface, a blade pivotally mounted adjacent said surface and having an outer scraper end engageable with said surface at a location adjacent said cleaning roller, washing means for supplying developing solution to said surface between said cleaning roller and said blade, said blade extending obliquely downwardly to said surface and entraining accumulated developing solution and developer loosened by said cleaning roller thereon, and liquid retaining means associated with said blade preventing the solution from falling downwardly to said surface.

9. A cleaning apparatus according to claim 8, wherein said developing unit further comprises a reservoir for holding said developing solution spaced below said surface, pump means for supplying said solution to said washing means from said reservoir, and return conduit means associated with said blade for returning said developing solution to said reservoir.

10. A cleaning apparatus according to claim 8 wherein said liquid retaining means further comprises a wall extending substantially upwardly from said blade at a position spaced from said surface on said blade, said wall forming a liquid weir.

11. A cleaning apparatus according to claim 8 wherein said liquid retaining means further comprises a throughshaped liquid retaining tray spaced below said pivotal blade, and a drainage pipe extending between said tray and said reservoir.

* * * * *